US006666417B1

(12) United States Patent
Wright

(10) Patent No.: US 6,666,417 B1
(45) Date of Patent: Dec. 23, 2003

(54) BABY BOTTLE ATTACHMENT

(76) Inventor: Patrick J. Wright, 2525 Pleasant Ave. South, Minneapolis, MN (US) 55404-4213

( * ) Notice: Subject to any disclaimer, the term of this patent is extended or adjusted under 35 U.S.C. 154(b) by 0 days.

(21) Appl. No.: 10/278,169

(22) Filed: Oct. 21, 2002

(51) Int. Cl.[7] ..... A47D 15/00

(52) U.S. Cl. ..... 248/103; 248/102; 248/311.2; 248/407

(58) Field of Search ..... 248/102, 103, 248/104, 105, 106, 311.2, 314, 298.1

(56) References Cited

U.S. PATENT DOCUMENTS

| | | | | | |
|---|---|---|---|---|---|
| 1,734,522 | A | * | 11/1929 | Kauffman | |
| 2,542,694 | A | | 2/1951 | Miller | 248/102 |
| 2,711,872 | A | * | 6/1955 | Lampke | 248/103 |
| 2,755,051 | A | * | 7/1956 | Cook | 248/102 |
| 3,253,084 | A | * | 5/1966 | Taylor | 174/52 |
| 4,655,715 | A | * | 4/1987 | Van de Carr et al. | 434/258 |
| D299,535 | S | * | 1/1989 | James | D24/48 |
| 5,044,509 | A | * | 9/1991 | Petrosky et al. | 215/366 |
| 5,072,843 | A | | 12/1991 | James | 215/100 |
| 5,135,189 | A | * | 8/1992 | Ghazizadeh | 248/104 |
| D334,983 | S | | 4/1993 | Nicholls | D24/195 |
| D361,385 | S | | 8/1995 | Harper | D24/199 |
| D375,796 | S | | 11/1996 | Beaver | D24/199 |
| 5,624,090 | A | | 4/1997 | Gammelgaard | 248/102 |
| 5,702,282 | A | * | 12/1997 | Beckman et al. | 446/267 |
| 5,769,367 | A | | 6/1998 | Bradley et al. | 248/102 |
| D402,761 | S | | 12/1998 | Jones | D24/199 |
| 5,842,901 | A | | 12/1998 | Montgomery | 446/77 |
| 5,880,811 | A | | 3/1999 | Parisi | 351/203 |
| 6,003,821 | A | | 12/1999 | Fabian et al. | 248/104 |
| 6,024,625 | A | | 2/2000 | Pearce | 446/81 |
| 6,037,872 | A | | 3/2000 | Dunnum | 340/586 |
| 6,158,870 | A | | 12/2000 | Ramirez | 362/101 |
| D451,201 | S | | 11/2001 | Maypa | D24/199 |
| 6,321,473 | B1 | * | 11/2001 | Klabunde | 40/310 |
| 6,398,061 | B2 | * | 6/2002 | Duff et al. | 220/592.16 |
| 6,446,952 | B1 | * | 9/2002 | Sheehy, Jr. | 269/277 |
| 2001/0013499 | A1 | * | 8/2001 | Morano et al. | 215/11.6 |
| 2002/0166926 | A1 | * | 11/2002 | Black | 248/105 |

* cited by examiner

*Primary Examiner*—Korie Chan
*Assistant Examiner*—Steven Marsh

(57) ABSTRACT

A baby bottle attachment for visually engaging a baby during feeding with a bottle. The baby bottle attachment includes a first housing for receiving a baby bottle, a second housing for adjustable receiving the first housing, and a visual indicator device attached to the second housing within the line of vision of the baby while the baby is drinking from the bottle. The visual indicator device is removably attached for allowing various designs to be provided to the baby as desired.

18 Claims, 4 Drawing Sheets

BABY BOTTLE ATTACHMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to baby bottles and more specifically it relates to a baby bottle attachment for visually engaging a baby during feeding with a bottle.

2. Description of the Related Art

Baby bottles have been in use for years. A conventional baby bottle is comprised of a tubular structure with a flexible nipple fluidly attached to an end of the tubular structure for drawing fluid from the interior of the tubular structure or a liner within the tubular structure.

The main problem with conventional baby bottles is that they do not provide any visual stimulation to a baby during feeding. Another problem with conventional baby bottles is that the baby may be easily distracted from feeding by a visual distraction away from the bottle. Another problem with conventional baby bottles is that the baby is not provided with any visual entertainment during feeding.

Examples of patented devices which may be related to the present invention include U.S. Pat. No. 5,624,090 to Gammelgaard; U.S. Pat. No. 5,880,811 to Parisi; U.S. Pat. No. 451,201 to Maypa; U.S. Pat. No. 6,003,821 to Fabian et al.; U.S. Pat. No. 5,072,843 to James; U.S. Pat. No. 402,761 to Jones; U.S. Pat. No. 375,796 to Beaver; U.S. Pat. No. 361,385 to Harper; U.S. Pat. No. 334,983 to Nicholls; U.S. Pat. No. 5,769,367 to Bradley et al.; U.S. Pat. No. 2,542,694 to Miller; U.S. Pat. No. 5,842,901 to Montgomery; U.S. Pat. No. 6,024,625 to Pearce; and U.S. Pat. No. 6,158,870 to Ramirez.

While these devices may be suitable for the particular purpose to which they address, they are not as suitable for visually engaging a baby during feeding with a bottle. Conventional baby bottles do not provide visual stimulation to a baby during feeding leaving the baby susceptible to visual distractions.

In these respects, the baby bottle attachment according to the present invention substantially departs from the conventional concepts and designs of the prior art, and in so doing provides an apparatus primarily developed for the purpose of visually engaging a baby during feeding with a bottle.

BRIEF SUMMARY OF THE INVENTION

In view of the foregoing disadvantages inherent in the known types of baby bottles now present in the prior art, the present invention provides a new baby bottle attachment construction wherein the same can be utilized for visually engaging a baby during feeding with a bottle.

The general purpose of the present invention, which will be described subsequently in greater detail, is to provide a new baby bottle attachment that has many of the advantages of the baby bottles mentioned heretofore and many novel features that result in a new baby bottle attachment which is not anticipated, rendered obvious, suggested, or even implied by any of the prior art baby bottles, either alone or in any combination thereof.

To attain this, the present invention generally comprises a first housing for receiving a baby bottle, a second housing for adjustable receiving the first housing, and a visual indicator device attached to the second housing within the line of vision of the baby while the baby is drinking from the bottle. The visual indicator device is removably attached for allowing various designs to be provided to the baby as desired.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a baby bottle attachment that will overcome the shortcomings of the prior art devices.

A second object is to provide a baby bottle attachment for visually engaging a baby during feeding with a bottle.

Another object is to provide a baby bottle attachment that is adjustable dependent upon the baby's eyesight.

An additional object is to provide a baby bottle attachment that receives various sizes and styles of baby bottles.

A further object is to provide a baby bottle attachment that reduces visual distractions to a baby during feeding with a bottle.

Another object is to provide a baby bottle attachment that provides visual stimulation to a baby during feeding with a bottle.

A further object is to provide a baby bottle attachment that allows for various visual stimulating devices to be attached.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
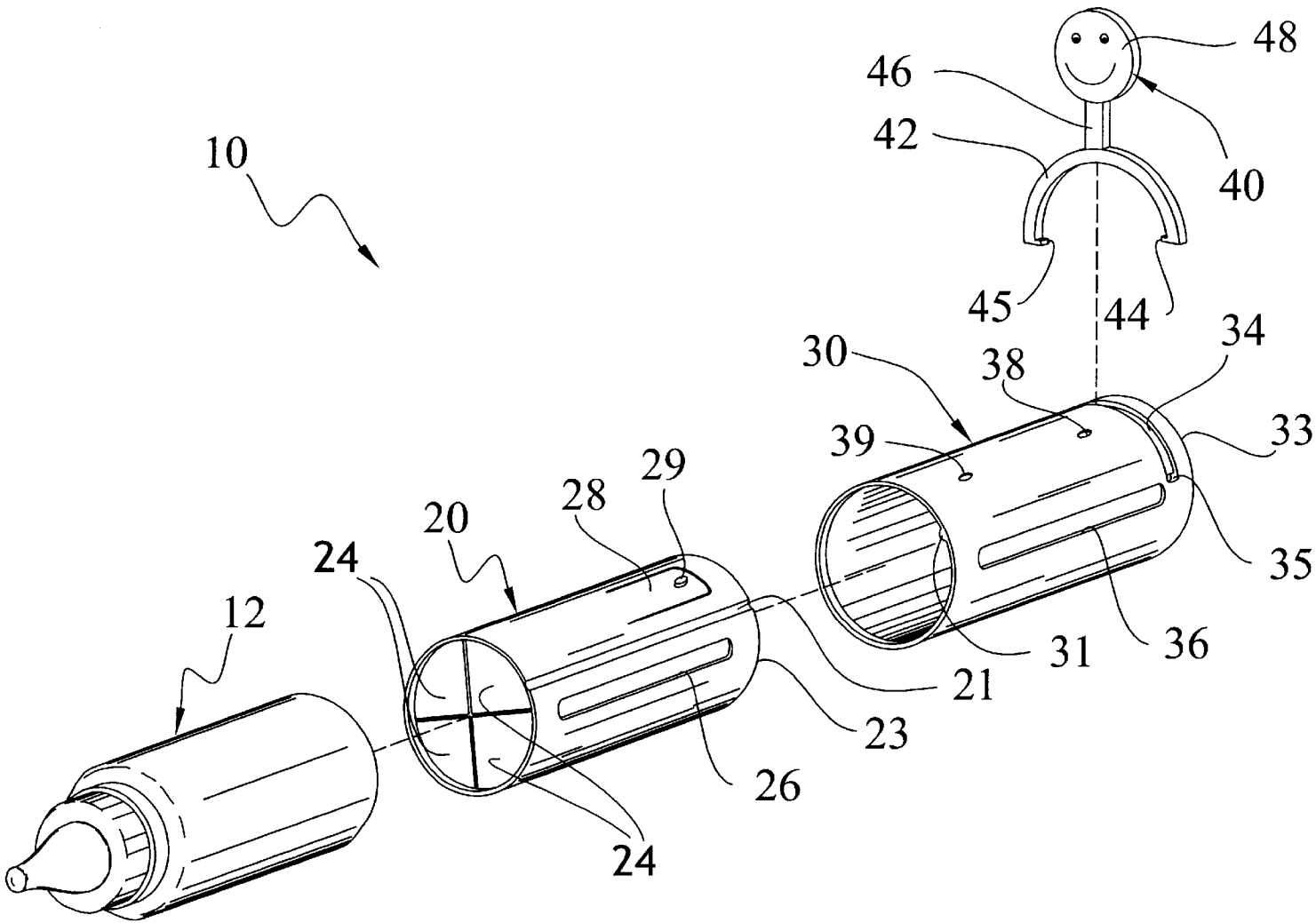
FIG. 1 is an exploded upper perspective view of the present invention with a bottle.

Turning now descriptively to the drawings, in which similar reference characters denote similar elements throughout the several views, FIGS. 1 through 5 illustrate a baby bottle attachment 10, which comprises a first housing 20 for receiving a baby bottle 12, a second housing 30 for adjustable receiving the first housing 20, and a visual indicator device 40 attached to the second housing 30 within the line of vision of the baby while the baby is drinking from the bottle 12. The visual indicator device 40 is removably attached for allowing various designs to be provided to the baby as desired.

FIG. 1 illustrates an exemplary baby bottle 12 that is removably received by the first housing 20. The first housing 20 is designed to receive various sizes and styles of bottles 12. The first housing 20 has a tubular structure having a first outer end 22 and a second inner end 23. The first outer end 22 of the first housing 20 is open for removably receiving the bottle 12 as best illustrated in FIG. 1 of the drawings. The first housing 20 preferably includes at least one first side slot 26 for allowing a caregiver to view the contents of the bottle 12.

The first outer end 22 preferably includes one or more flap members 24 for frictionally engaging the bottle 12 in a secured position within the first housing 20. The flap members 24 are preferably comprised of a flexible material such as but not limited to rubber or plastic. The flap members 24 may be divided from one another by a plurality of slits as further shown in FIG. 1 of the drawings. The flap members 24 allow for receiving various sizes and styles of bottles 12 within the first housing 20 without requiring the usage of a different sized first housing 20.

In addition to or in exclusion of using the flap members 24 within the first housing 20, a plurality of elongate rib members 25 may extend from the interior surface of the first housing 20 for frictionally engaging the exterior of the bottle 12. The rib members 25 may be comprised of the same material as the first housing 20 or comprised of a resilient material such as but not limited to rubber. The rib members 25 extend substantially parallel to a longitudinal axis of the first housing 20. The rib members 25 may have a constant size or the rib members 25 may be tapered for allowing easier insertion of the bottle 12.

As shown in FIGS. 1 through 5 of the drawings, a second housing 30 is provided that slidably receives the first housing 20. The second housing 30 has a tubular structure having a first inner end 32 and a second outer end 33. The second housing 30 has an interior diameter sufficient for slidably receiving the first housing 20. The second housing 30 has a second side slot 36 that corresponds to the first side slot 26 for allowing the caregiver to view the contents of the bottle 12.

Figure 2:
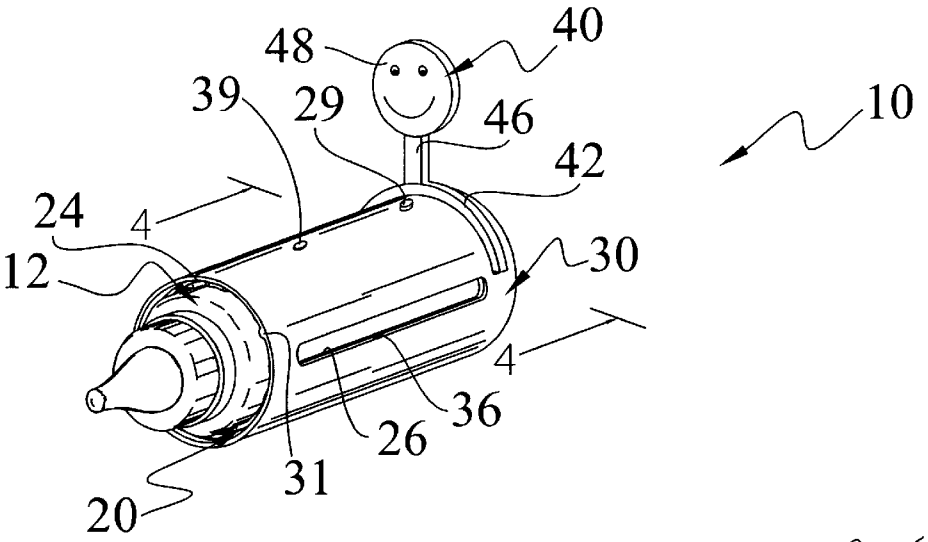
FIG. 2 is an upper perspective view of the present invention in a contracted position.
Figure 3:
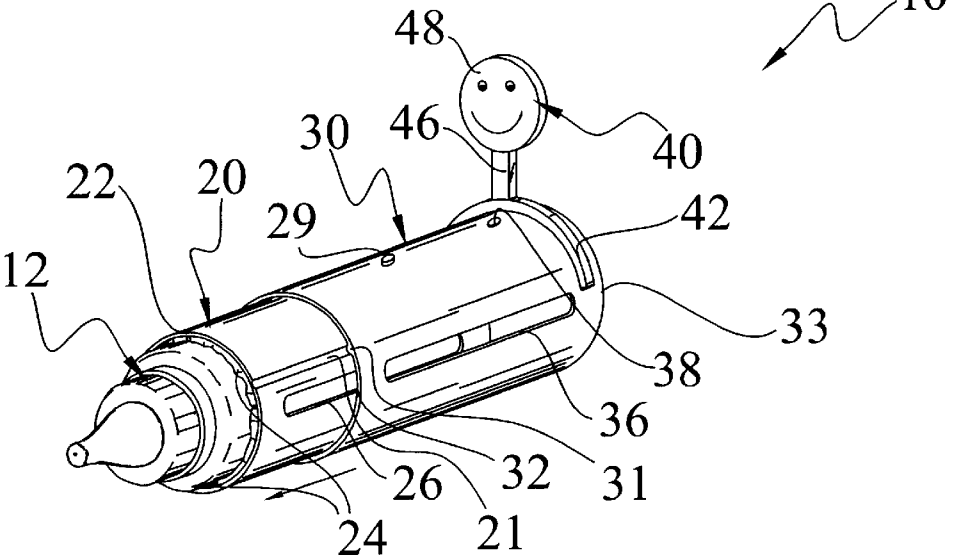
FIG. 3 is an upper perspective view of the present invention in an expanded position.
Figure 5:
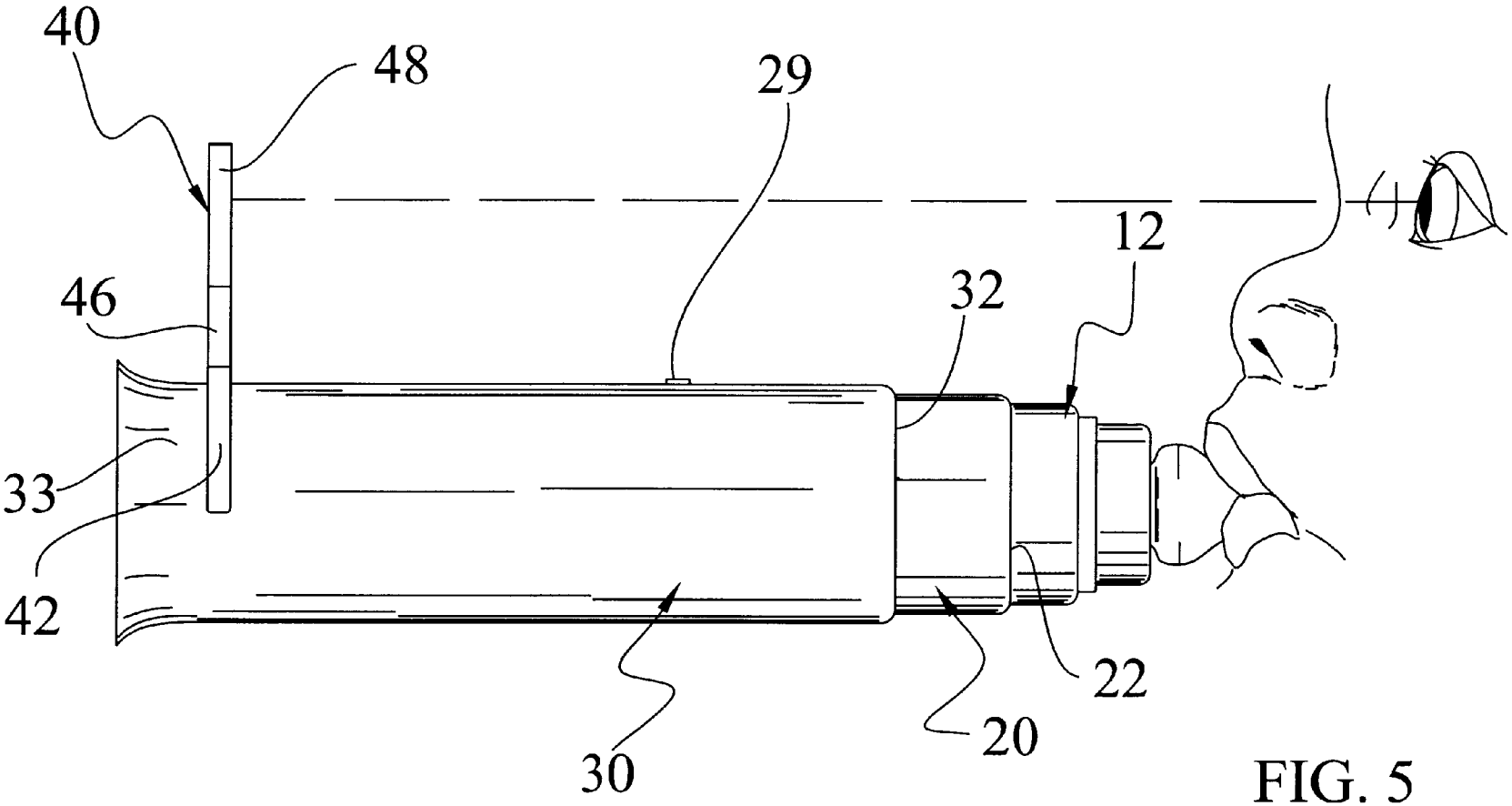
FIG. 5 is a side view of the present invention retaining a bottle which a baby is drinking from illustrating the visual line-of-sight.

The second housing 30 includes one or more apertures 38, 39 for receiving a catch member 29 extending from a clip member 28 of the first housing 20 as shown in FIG. 1 of the drawings. The clip member 28 is flexibly positioned within the first housing 20 and applies an upward force upon the catch member 29. The catch member 29 is secured within a desired aperture 38, 39 depending upon the desired distance of the baby's eyes from the visual indicator device 40 as shown in FIGS. 2, 3 and 5 of the drawings.

Figure 4:
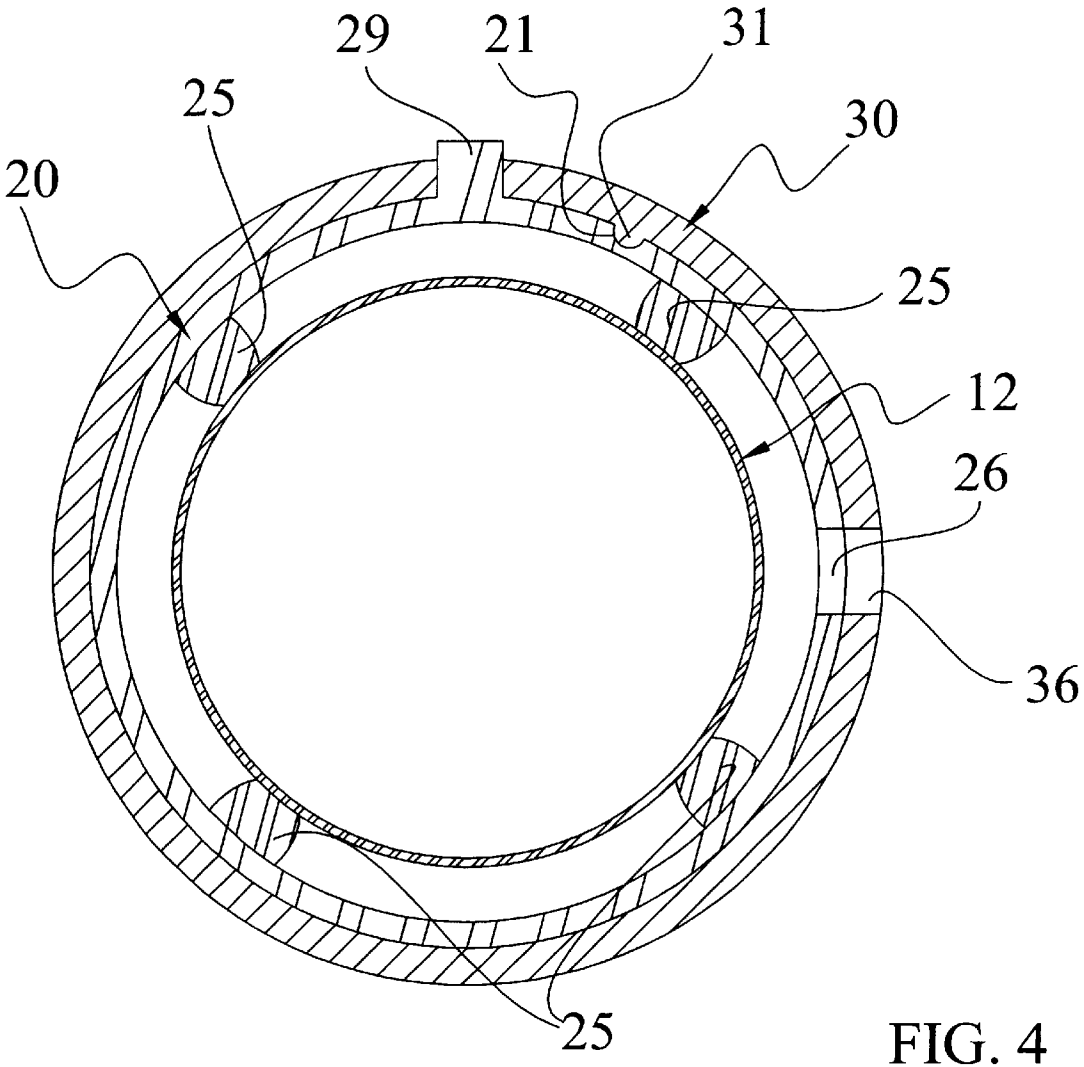
FIG. 4 is a cross sectional view taken along line 4—4 of FIG. 2.

As best shown in FIGS. 1 and 4 of the drawings, the first housing 20 may include one or more elongate grooves 21 for receiving a corresponding alignment rib 31 from the second housing 30. The alignment rib 31 within the elongate grooves ensures that the first housing 20 is properly aligned with the second housing 30.

A visual indicator device 40 is removably attached to the second housing 30. A receiving slot 34 receives a clamp member 42 of the visual indicator device 40 as shown in FIG. 1 of the drawings. The clamp member 42 has an arcuate shape formed to fit upon the second housing 30. A pair of opposing catch cutouts 35 within the second housing 30 catchably receive a first hook 44 and a second hook 45 of the clamp member 42. A neck member 46 extending from the clamp member 42 supports a support member 48 having a visual indicator device 40 upon thereof at a desired height that provides adequate viewing of the visual indicator device 40 by a baby. The visual indicator may be comprised of various designs, colors and appearances that may be visually attractive and pleasing to a baby. The support member 48 may have various shapes and sizes such as circular, rectangular and the like.

In use, the user positions the bottle 12 filled with the desired fluid within the first housing 20. The flap members 24 and the rib member retain the bottle 12 within the first housing 20 without movement. The user then positions the first housing 20 within the second housing 30 at the desired visual distance. If the eyesight of the baby has not developed, then the user would position the catch member 29 within the second aperture 39 of the second housing 30. If the eyesight of the baby has developed, then the user would position the catch member 29 within the first aperture 38 of the second housing 30. The user then secures the desired visual indicator device 40 to the second housing 30 which will provide the desired visual stimulation to the baby during feeding upon the bottle 12. The line of vision from the eyes of the baby to the support member 48 is preferably substantially parallel to the exterior surface of the bottle 12 as best illustrated in FIG. 5 of the drawings. The baby feeds upon the bottle 12 and is able to visually locate and monitor the indicia upon the surface of the support member 48 thereby visually stimulating the baby and maintaining their attention upon feeding. The user may change the visual indicator device 40 at any time if desired to achieve differing visual appearances.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baby bottle attachment, comprising:

a first housing for receiving a bottle;

a second housing slidably receiving said first housing, wherein said first housing, said second housing and said bottle are concentric with one another; and a visual indicator device attached to said second housing at a level viewable by a baby while feeding upon a bottle within said first housing;

wherein said visual indicator device is removably attached to said second housing, wherein said visual indicator device is comprised of:

a clamp member;

a first hook and a second hook extending from distal ends of said clamp member, wherein said hooks are catchably received by a corresponding pair of catch cutouts within said second housing; and a support member attached to said clamp member by a neck member, wherein said support member includes a visual indicia viewable by a baby feeding upon a bottle within said first housing.

2. The baby bottle attachment of claim 1, wherein said clamp member has an arcuate shape.

3. The baby bottle attachment of claim 2, wherein said second housing includes a receiving slot for receiving said clamp member.

4. The baby bottle attachment of claim 1, wherein said first housing has a first outer end having at least one flap member.

5. The baby bottle attachment of claim 1, wherein an interior of said first housing includes a plurality of rib members.

6. The baby bottle attachment of claim 5, wherein said rib members are tapered.

7. The baby bottle attachment of claim 1, wherein said first housing includes a first side slot and said second housing includes a second side slot.

8. The baby bottle attachment of claim 7, wherein said first slot and said second slot are aligned with one another.

9. A baby bottle attachment, comprising:

a first housing for receiving a bottle;

a groove extending longitudinally along an exterior of said first housing;

a plurality of apertures within a second housing;

a said second housing slidably receiving said first housing;

an alignment rib within said second housing for slidably extending within said groove for aligning said first housing and said second housing;

a clip member springably positioned within said first housing;

a catch member extending from said clip member for being removably inserted into one of said plurality of apertures; and a visual indicator device attached to said second housing at a level viewable by a baby while feeding upon a bottle within said first housing.

10. The baby bottle attachment of claim 9, wherein said visual indicator device is removably attached to said second housing.

11. The baby bottle attachment of claim 9, wherein said visual indicator device is comprised of:

a clamp member;

a first hook and a second hook extending from distal ends of said clamp member, wherein said hooks are catchably received by a corresponding pair of catch cutouts within said second housing; and a support member attached to said clamp member by a neck member, wherein said support member includes a visual indicia viewable by a baby feeding upon a bottle within said first housing.

12. The baby bottle attachment of claim 11, wherein said clamp member has an arcuate shape.

13. The baby bottle attachment of claim 12, wherein said second housing includes a receiving slot for receiving said clamp member.

14. The baby bottle attachment of claim 9, wherein said first housing has a first outer end having at least one flap member.

15. The baby bottle attachment of claim 9, wherein an interior of said first housing includes a plurality of rib members.

16. The baby bottle attachment of claim 15, wherein said rib members are tapered.

17. The baby bottle attachment of claim 9, wherein said first housing includes a first side slot and said second housing includes a second side slot.

18. The baby bottle attachment of claim 17, wherein said first slot and said second slot are aligned with one another.

* * * * *